US007750766B2

(12) United States Patent
Bonetti et al.

(10) Patent No.: US 7,750,766 B2
(45) Date of Patent: Jul. 6, 2010

(54) AUTOMATIC CIRCUIT BREAKER WITH TRIPPING DEVICE ACTIVATED BY A MOVABLE CONTACT

(75) Inventors: Luigi Bonetti, Bergamo (IT); Nicola Bresciani, Bergamo (IT)

(73) Assignee: ABB S.p.A., Milan (IT)

( * ) Notice: Subject to any disclaimer, the term of this patent is extended or adjusted under 35 U.S.C. 154(b) by 427 days.

(21) Appl. No.: 11/719,581

(22) PCT Filed: Oct. 18, 2005

(86) PCT No.: PCT/EP2005/011250

§ 371 (c)(1),
(2), (4) Date: May 17, 2007

(87) PCT Pub. No.: WO2006/053619

PCT Pub. Date: May 26, 2006

(65) Prior Publication Data

US 2009/0072933 A1 Mar. 19, 2009

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 9/00*** | (2006.01) |

(52) U.S. Cl. ..... 335/6; 335/16; 335/176

(58) Field of Classification Search ..... 335/6, 335/16, 176

See application file for complete search history.

(56) References Cited

U.S. PATENT DOCUMENTS

| | | | | | |
|---|---|---|---|---|---|
| 2,859,300 | A | * | 11/1958 | Platz et al. | 335/45 |
| 3,005,073 | A | * | 10/1961 | Reiss et al. | 335/16 |
| 3,272,953 | A | | 9/1966 | Tillson | |
| 3,309,637 | A | * | 3/1967 | Jencks | 335/176 |
| 3,534,305 | A | * | 10/1970 | Strobel | 335/16 |
| 3,569,879 | A | * | 3/1971 | Gryctko | 335/176 |
| 3,646,488 | A | * | 2/1972 | Iida et al. | 335/16 |
| 3,949,331 | A | * | 4/1976 | Cellerini et al. | 335/45 |
| 4,118,680 | A | * | 10/1978 | Borona | 335/176 |
| 4,153,828 | A | | 5/1979 | Barkan | |
| 4,278,958 | A | * | 7/1981 | Kandatsu | 335/16 |
| 4,313,098 | A | * | 1/1982 | Salvati | 335/42 |
| 4,635,011 | A | * | 1/1987 | Leone et al. | 335/16 |

(Continued)

FOREIGN PATENT DOCUMENTS

| | | |
|---|---|---|
| DE | 1463311 | 2/1969 |

(Continued)

*Primary Examiner*—Elvin G Enad
*Assistant Examiner*—Alexander Talpalatskiy
(74) *Attorney, Agent, or Firm*—Connolly Bove Lodge & Hutz LLP; Arlene P. Neal

(57) ABSTRACT

Embodiments of an automatic single- or multi-pole circuit breaker for use in low-voltage applications are disclosed. The circuit breaker includes at least a first fixed contact this is coupled/uncoupled with a first moving contact. The moving contact is operatively connected to an operating mechanism that enables its displacement. The circuit breaker includes a kinematic tripping device driven by means of a first separating movement of the moving contact away from the fixed contact. The kinematic tripping device includes an operative member capable of tripping the operating mechanism, which in turn takes effect on the moving contact, thus determining a second rapid separating movement until the circuit breaker tripped position is reached.

11 Claims, 5 Drawing Sheets

U.S. PATENT DOCUMENTS

| | | | | | |
|---|---|---|---|---|---|
| 4,639,700 | A | * | 1/1987 | Shestak et al. | 335/6 |
| 4,644,307 | A | * | 2/1987 | Tanimoto | 335/16 |
| 4,945,325 | A | * | 7/1990 | Toda et al. | 335/16 |
| 4,998,081 | A | * | 3/1991 | Boyd | 335/6 |
| 5,004,878 | A | * | 4/1991 | Seymour et al. | 218/155 |
| 5,103,198 | A | | 4/1992 | Morel et al. | |
| 5,469,121 | A | * | 11/1995 | Payet-Burin | 335/16 |
| 5,731,560 | A | * | 3/1998 | Nebon et al. | 218/22 |
| 5,793,270 | A | * | 8/1998 | Beck et al. | 335/16 |
| 6,018,284 | A | * | 1/2000 | Rival et al. | 335/16 |
| 6,262,642 | B1 | * | 7/2001 | Bauer | 335/16 |
| 6,403,909 | B1 | * | 6/2002 | Green et al. | 218/22 |
| 6,437,670 | B1 | * | 8/2002 | Castonguay et al. | 335/6 |
| 6,480,080 | B1 | * | 11/2002 | Asada et al. | 335/6 |
| 6,489,867 | B1 | * | 12/2002 | Turner et al. | 335/6 |

FOREIGN PATENT DOCUMENTS

| | | | |
|---|---|---|---|
| DE | 29511457 | U1 | 1/1997 |
| EP | 0419276 | A2 | 3/1991 |
| EP | 1026719 | A2 | 8/2000 |

* cited by examiner

AUTOMATIC CIRCUIT BREAKER WITH TRIPPING DEVICE ACTIVATED BY A MOVABLE CONTACT

CROSS-REFERENCE TO RELATED APPLICATION

This application is a National Stage entry under the PCT of International Application PCT/EP2005/011250 filed on Oct. 18, 2005, which claims priority to MI2004A002234 filed on Nov. 19, 2004. The entire contents of each application are incorporated herein by reference.

The present invention pertains to an automatic single- or multi-pole circuit breaker preferably for use in low-voltage electric systems.

Automatic circuit breakers are devices designed to protect an electric network and the loads connected thereto against anomalous events, e.g. overloads and short-circuits, by automatically opening the circuit. An automatic circuit breaker normally includes fixed and moving main contacts, contact springs, devices for achieving a controlled movement of said moving contacts, current detection devices, safety devices and automatic release devices. The safety devices can normally be of thermal, magnetic, thermomagnetic, or electronic type. Said safety devices serve the main purpose of tripping the automatic release of the circuit breaker whenever an anomalous event occurs. Said tripping command is normally transmitted mechanically, by means of levers or solenoids that take action on the automatic release by means of a trip shaft, thus releasing the potential energy contained in springs provided for said purpose. Said potential energy is suitably conveyed, by means of kinematic chains, to the moving contacts, which must be separated from the fixed contacts at the end of the tripping operation.

In addition or as an alternative to the above-described safety devices, so-called current-limiting devices can also be used. Said devices exist in various forms in the known state of the art and serve the purpose of making the circuit breaker's contacts separate when a short-circuit occurs, regardless of any action being taken by other safety devices installed.

The most common type of limiting device is based on a special configuration of the contacts and of the related electrodes designed to ensure the spontaneous repulsion of the moving contact away from the fixed contact due to the electrodynamic forces that develop in the event of a short-circuit. These forces are known to act in the opposite direction to the forces exerted by the contact springs when an automatic circuit breaker is in the closed position. Said forces of repulsion depend on the intensity of the current and, in rated current conditions, they must be kept considerably lower than the forces exerted by the contact springs in order to guarantee the circuit breaker an optimal conductivity. Limiting devices are designed so that it is only in the event of short-circuit currents of a given value that the electrodynamic repulsion forces can overcome the forces exerted by the contact springs and thus induce the separation of the moving contacts from the fixed contacts.

After the contacts have separated due to said electrodynamic repulsion, there must be other devices to prevent the moving contacts from returning up against the fixed contacts—i.e. to prevent the risk of arc re-ignition—as well as other devices to provide a suitable signal outside the switching device to indicate the separated state of the contacts, or "device tripped". This dual purpose is normally achieved by fitting the limiting devices with sensors capable of detecting the separation of the contacts and subsequently tripping the release device irrespective of any action being taken by the safety device.

The operation of the sensors used in the known state of the art to trip the release device after the contacts have separated is based on the detection of electrodynamic phenomena collateral to the separation of the contacts.

The patent application U.S. Pat. No. 5,103,198, for instance, illustrates a sensor that is sensitive to the local increase in pressure that occurs in the vicinity of contacts when a short-circuit takes place. An alternative to this type of sensor is described in the patent application U.S. Pat. No. 4,644,307, illustrating a circuit breaker wherein the limiting device is integrated with a sensor that is sensitive to the magnetic field created around the arcing area when the contacts separate.

Both types of sensor mentioned above present several drawbacks.

Solutions based on local pressure recordings, for instance, are not only somewhat complex from the structural point of view and consequently expensive, and they also demand a perfect state of maintenance in order to be able to function with an adequate degree of reliability. Moreover, the adjustment of these sensors may deteriorate with time due to progressive deterioration of their sensitive surfaces as a result, for instance, of the deposition of locally sublimated material following the opening of the circuit breaker.

The conventional solutions sensitive to the magnetic field are generally more reliable as concerns the above-mentioned drawbacks, but well-known saturation phenomena make them difficult to adjust, especially when high settings are required.

Using transduction chains to transmit the signal leads to an inevitable alteration of said signal, reducing the precision of the circuit breaker and introducing unwanted delays in the response of the circuit breaker.

In view of the above, the main aim of the present invention is to provide an automatic single- or multi-pole low-voltage circuit breaker that enables the above-described drawbacks to be overcome.

In the context of said aim, a first object of the present invention is to provide an automatic circuit breaker wherein the operation to trip the contacts is achieved by means of a limited number of components that are easy to assemble together.

A second object of the present invention is to provide an automatic circuit breaker that requires no complicated and costly maintenance operations to guarantee a perfect functionality of the contact tripping operation.

Another object of the present invention is to provide an automatic circuit breaker whose setting is reasonably immune to any variations that may be caused by normal operation.

A further object of the present invention is to provide an automatic circuit breaker allowing for a wide range of possible settings.

Another, object of the present invention is to provide an automatic circuit breaker that is highly reliable and relatively easy to manufacture at competitive prices.

This aim and the above-stated objects, as well as others that will be more clear from the description, are achieved by means of an automatic circuit breaker according to the appended claim 1.

The automatic circuit breaker according to the present invention enables the moving contact to be exploited directly, not only for its principal function, but also to actuate the kinematic tripping system and the consequent command mechanism, thereby eliminating the need to use further additional devices or transducers, such as the pressure sensors or electromagnetic sensors normally used for said purpose. Moreover, using a substantially mechanical kinematic tripping system enables a circuit breaker response to be obtained that is extremely rapid and precise, according to the established setting.

Further features and advantages of the invention will become apparent from the description of preferred, but not exclusive, embodiments of the automatic circuit breaker according to the invention, illustrated as a non-restrictive example in the attached drawings, wherein.

With reference to the above-mentioned figures, the automatic circuit breaker 1 according to the invention consists of at least one first fixed contact 10 and at least one first moving contact 20, which are mutually coupled and uncoupled in the vicinity of a first active coupling area 15.

Figure 1:
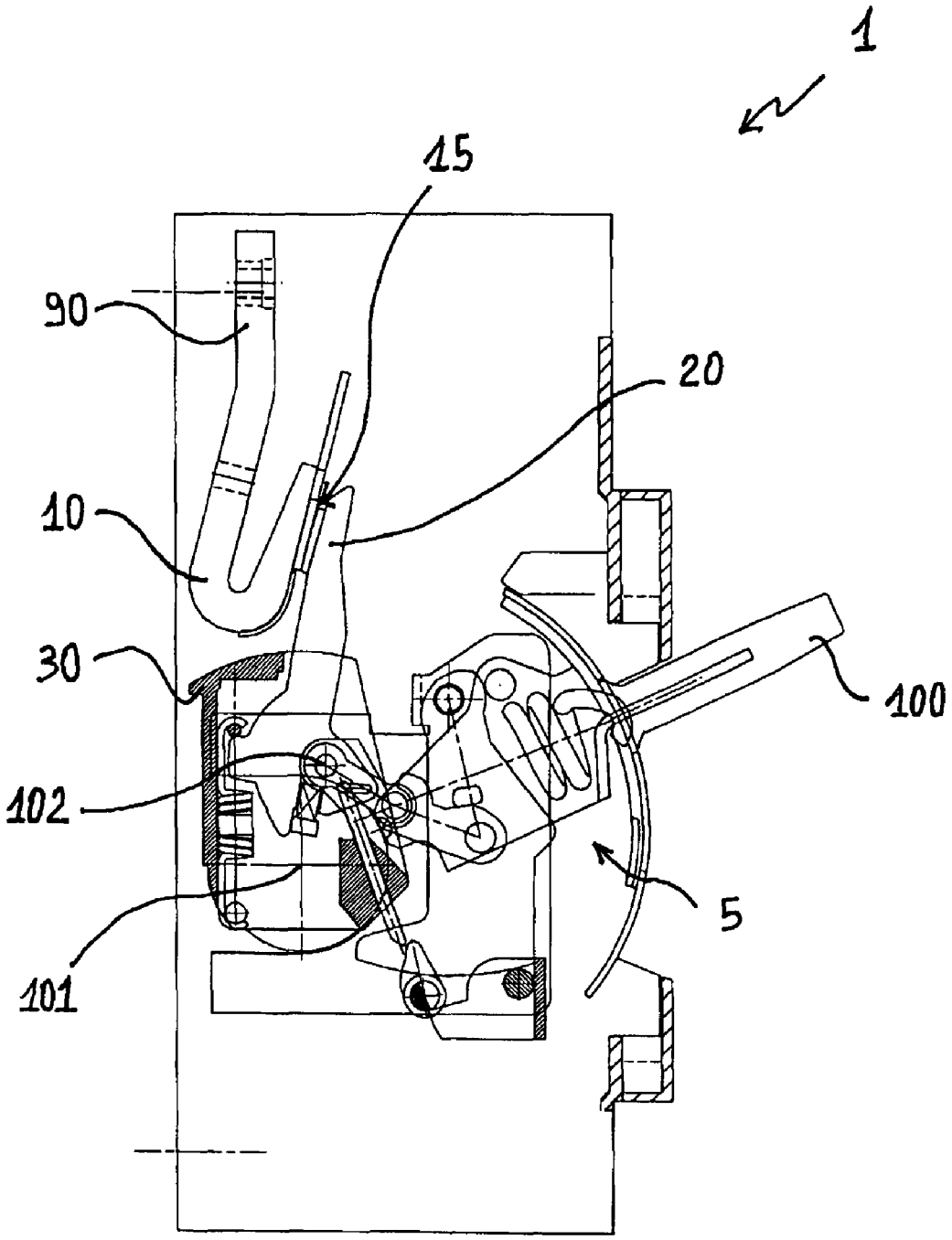
FIG. 1 is a schematic view showing a first embodiment of an automatic circuit breaker according to the invention in the closed position.

FIG. 1 illustrates a possible arrangement of said contacts. In particular, the first fixed contact 10 is connected to an electrode 90, which is connected in turn to an electric network and has a particular "hooked" configuration suitable for creating a substantially opposite flow of current in the vicinity of the parts of the contacts close to the active coupling area 15. The flow of current thus created is sufficient to generate a spontaneous repulsion of the contacts in the event of a short-circuit.

The first moving contact 20 illustrated in FIG. 1 is a rotating contact driven by means of an operating mechanism 5 operatively connected thereto. The operating mechanism 5 (a possible embodiment of which will be illustrated later on in this description) enables the circuit breaker 1 to be closed, i.e. it enables the rapid coupling of the contacts 10 and 20, by means of a manual action by an operator, for instance, which is normally achieved using an operating lever 100. The operating mechanism 5 also enables the rapid separation of the contacts 10 and 20, i.e. the rapid opening of the circuit breaker 1 in order to reach a condition of the circuit breaker 1 normally defined as "tripped".

The automatic circuit breaker 1 according to the invention is characterized in that it comprises a kinematic tripping device operatively connected to said moving contact 20 and destined to actuate said operating mechanism 5 by means of an operative member. The kinematic tripping device is actuated directly by the first separating movement of the moving contact 20 away from the fixed contact 10, induced by an electrodynamic repulsion effect generated in the vicinity of said active coupling area 15 as a result of a substantially opposite flow of current in the two coupled contacts 10 and 20. When the kinematic tripping device is displaced, it enables said operating mechanism 5, which completes the separation of the contacts 10 and 20 by generating a second rapid movement of the moving contact 20 until it reaches a preset position corresponding to the circuit breaker tripped condition. This condition is suitably signaled, as required by the standards, by the position occupied by the operating lever 100, which is moved as a result of the operating mechanism 5 being enabled.

The automatic circuit breaker 1 designed in this way ensures the rapid separation of the contacts by exploiting the displacement of the moving contact 20 generated by the forces of electrodynamic repulsion. Basically, the moving contact 20 acts as an actuator of the kinematic tripping device, that is to say the operating mechanism 5. Conversely, the known solutions make the contacts separate by exploiting collateral effects induced by the forces of electromagnetic repulsion (e.g. a rise in pressure or a variation in the magnetic field), rather than a direct mechanical effect, such as the displacement of the moving contact 20.

Figure 2:
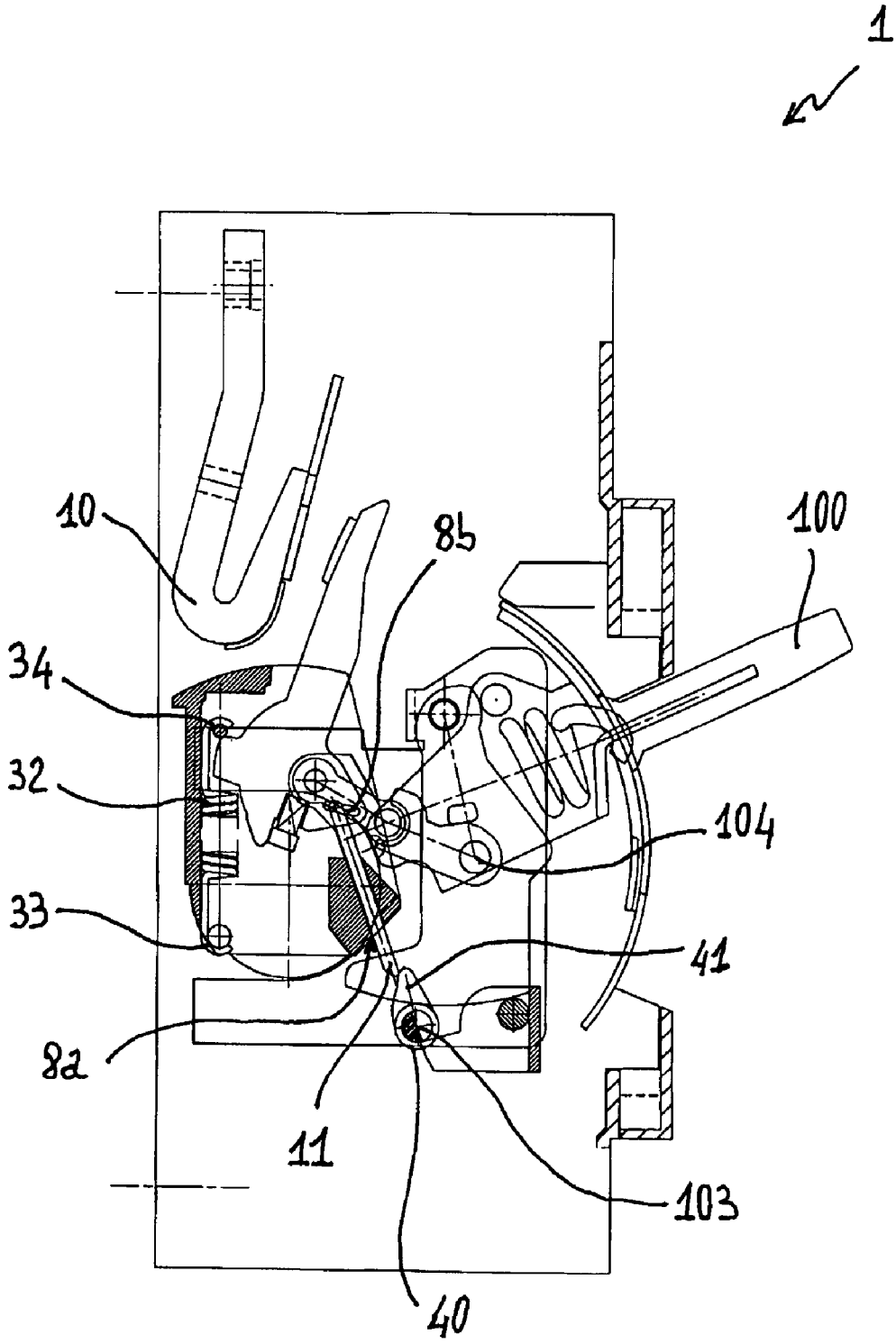
FIG. 2 is a schematic view of the circuit breaker in FIG. 1 during the initial stage of repulsion of the contacts due to the effect of the electrodynamic forces.

With reference to FIG. 1, in one of its possible embodiments, the circuit breaker 1 comprises a moving part 30, preferably made of insulating material, which contains at least part of the moving contact 20 that, as explained above, is of the rotating type. The moving part 30 is free to turn around a first center of rotation 101, that is fixed with respect to the circuit breaker 1, while the moving contact 20 turns around a second center of rotation 102, that is fixed with respect to the moving part 30. As illustrated in FIG. 2, for instance, the terminal part of the first moving contact 20 extends from the moving part so as to match said first fixed contact 10 in the vicinity of said first active area 15.

Inside the moving part 30, there is at least one contact spring 32, fastened at one end 33 to said moving part 30 and at the other end 34 to the moving contact 20. The contact spring 32 acts on the moving contact 20 so as to contrast the action (in the desired operating conditions at least) of the electromagnetic repulsion forces. Clearly, the choice of the spring 32 is very important for the calibration of the circuit breaker 1, since it defines the functioning of the latter. In practical terms, the mechanical characteristics of the contact spring 32 identify the limit for the electric load beyond which the contacts begin to separate.

According to a preferred embodiment of the invention, the circuit breaker 1 consists of a trip shaft 40 whose displacement directly actuates the operating mechanism 5. In the case illustrated, the movement of the trip shaft 5 consists in its rotation around a third fixed center of rotation 103 and is induced directly by the operative member of the kinematic tripping device.

In the solution illustrated in FIGS. 1 to 4, the operative member of said kinematic tripping device consists of a sliding rod 11 with one operative extremity 11*a* suitable for intercepting the trip shaft 40 in order to induce its displacement. To be more precise, said first operative extremity 11*a* intercepts a shaped protrusion 41 extending from said trip shaft 40. The moving part 30 includes a first seat 8*a* for slidingly containing the sliding rod 11. Said first seat 8*a* guides the rod 11 towards the trip shaft 40 in order to guide the rod 11 towards the shaped protrusion 41.

In a preferred embodiment, the first moving contact 20 includes a second seat 8*b*, wherein a second operative extremity 11*b* of the sliding rod 11 is slidingly engaged. Based on the above description, the kinematic tripping device illustrated in FIGS. 1 to 4 has three members that are mutually coupled by means of two kinematic pairs. To be more specific, the first moving contact 20 is coupled to the sliding rod 11 by means of a kinematic pair with two degrees of freedom, while the sliding rod 11 is coupled to said moving part 30 by means of a substantially axial kinematic pair, wherein the first seat 8*a* allows for only one relative translational movement of said sliding rod 11.

In the hitherto illustrated kinematic tripping device, the sliding rod II moves as soon as the moving contact 20 is displaced because the two elements are mutually coupled and consequently physically connected by means of a positive connection. The inventive concept naturally also covers the solution in which the sliding rod 1 is not connected physically to said moving contact 20, but is moved instead after the latter has undergone a certain displacement.

It should be noted, moreover, that some parts of the circuit breaker 1 hitherto illustrated may be entirely replaced by other, equivalent parts without this interfering with the applicability of the kinematic tripping device according to the invention. For instance, the moving part 30 can be replaced by a traditional contact moving shaft.

The inventive concept also covers the possibility of said first moving contact 20 displacing the trip shaft 40 by means of a rigid or elastic extension. In this case, the extension of the moving contact 20 consequently works as operative member of the kinematic system. As can be seen from the above description, the kinematic tripping device operatively connects the moving contact 20 to the trip shaft 40 so that the tripping of the circuit breaker 1 coincides with a preset first separating movement of the moving contact 20 away from the fixed contact 10. In a circuit breaker with rotating contacts, such as the one hitherto described, it should be noted that the angle of opening between the contacts $\alpha$ depends on the power of the arc, which is indicative of the entity of the short-circuit. Using this type of kinematic tripping device, the tripping threshold can be adjusted according to the power of the passing arc by choosing a suitable angle $\alpha$ with which to associate the tripping of the operative member of the kinematic tripping device.

A similar reasoning applies to the case when the first moving contact is of axial type, i.e. it has an axial displacement instead of an angular displacement. In this case, the adjustment can be made by suitably choosing the axial displacement with which to associate the tripping of the device.

The figures provided illustrate a preferred, but not exclusive, embodiment of the operating mechanism 5. To be more precise, this mechanism consists of a first rotating body 51 hinged to supporting sides 55 and operatively connected to the trip shaft 40. Situated preferably between the trip shaft 40 and the first rotating body 51, there is a trigger 99 whose purpose will be explained later on. A first connecting rod 61 is hinged to the first rotating body 51 in line with a first axis 104, while a second connecting rod 62 is hinged to said moving part 30. The two connecting rods 61 and 62 are mutually connected by means of a kinematic knee 63 consisting substantially of a kinematic pair with a rotary joint. An operating spring 95 acts on said kinematic knee 63 and is preloaded by means of an operating lever 100. To understand the operating principle of the circuit breaker 1 and how the tripping mechanism is enabled, the figures are further discussed below, emphasizing the respective positions occupied by the circuit breaker components.

FIG. 1 shows the circuit breaker in the closed position. The first moving contact 20 is coupled to the fixed contact in the vicinity of the first active coupling area 15 and is kept pressed thereon by the contact spring 33. The operating lever 100 is in a position indicating the closed state of the circuit breaker, while the actuating spring 95 is loaded.

FIG. 2 shows the initial contact releasing stage. The rotation of the moving contact 20 forces the sliding rod 11 to move along the first seat 8*a* in the moving part 30. The operating mechanism 5 begins to trip when the first operative extremity 11*a* of the sliding rod 11 intercepts the trip shaft 40.

Figure 3:
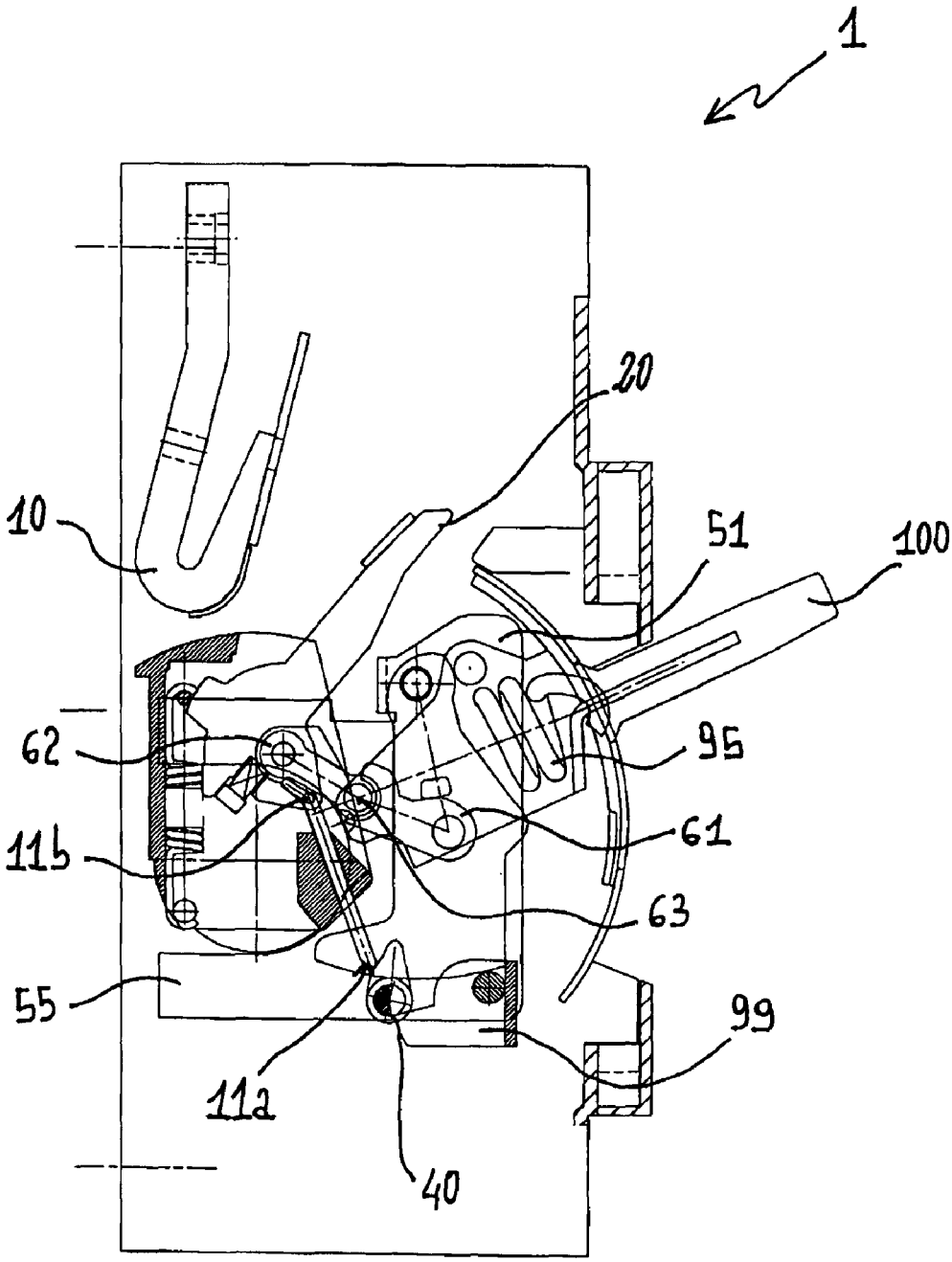
FIG. 3 is a schematic view of the circuit breaker in FIG. 1 during the initial stage of the tripping of said circuit breaker.

With reference to FIG. 3, the trip shaft 40 is shaped so as to release the trigger 99 after a preset rotation around its own axis 103. When the trigger 99 is released, it allows for the rotation of the first rotating body 51 around the corresponding axis of rotation 105, enabling the operating spring 95 to release the previously-stored energy onto the kinematic knee 63. This displaces said knee downwardly, inducing a corresponding movement of the second connecting rod 62, which in turn causes the rotation of the moving part 30, thus enabling a second rapid separating movement of the contacts.

Figure 4:
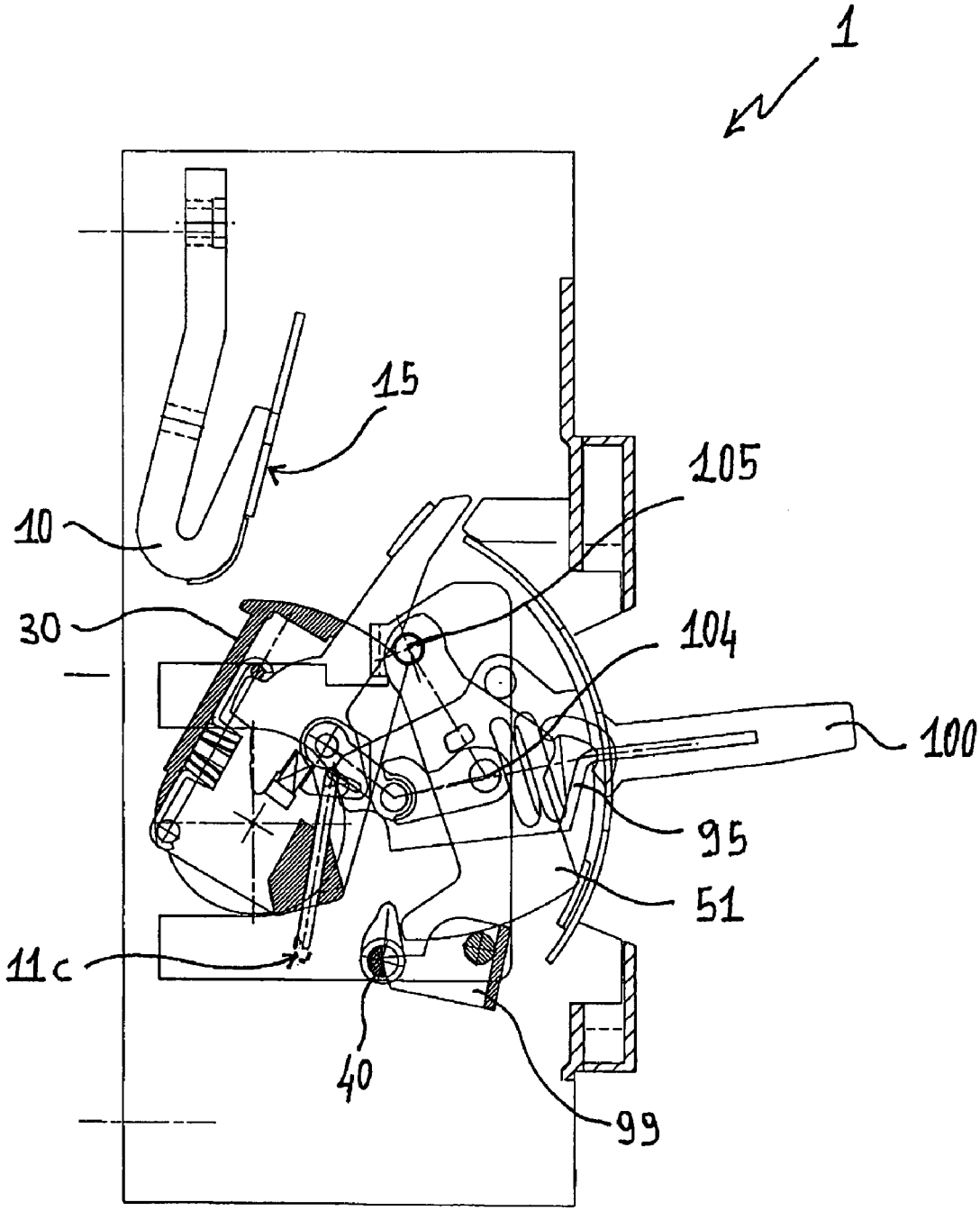
FIG. 4 is a schematic view of the circuit breaker in FIG. 1 after the circuit breaker tripped position has been reached.

FIG. 4 shows the respective positions of the components in the circuit breaker 1 after the separation of the contacts has been completed.

It should be noted that the above-illustrated embodiment of the operating mechanism 5 is purely by way of example, since the described kinematic tripping device and other possible equivalents can trip any type of conventionally known operating mechanism.

Figure 5:
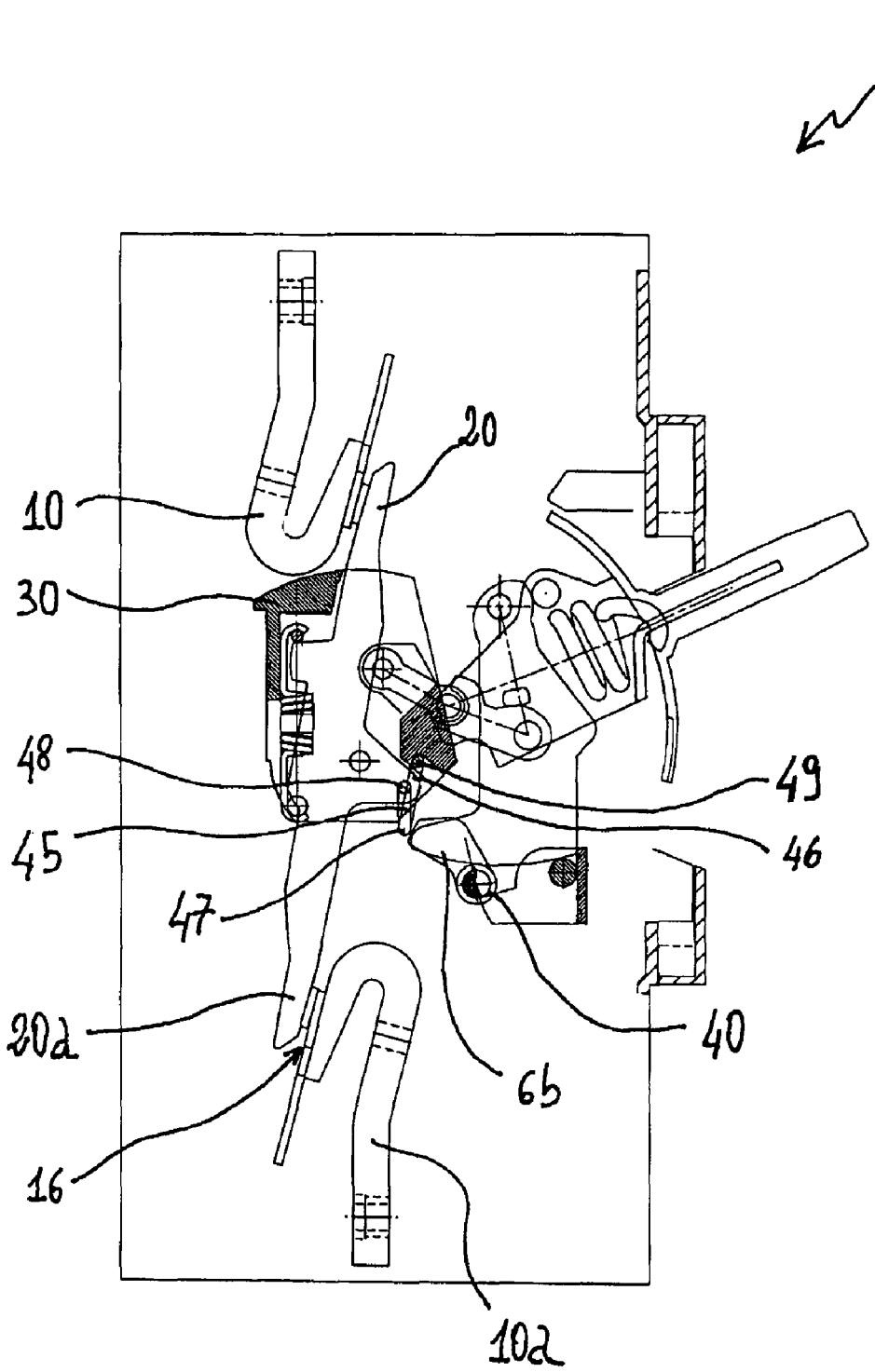
FIG. 5 is a schematic view showing a second embodiment of an automatic circuit breaker according to the invention.

FIG. 5 illustrates a second embodiment of the automatic circuit breaker 1 according to the invention. In this second example, the circuit breaker 1 is of the "double interruption" type and comprises a second fixed contact 10*a*, which is coupled and uncoupled with a second moving contact 20*a* in line with a second active coupling area 16. To be more specific, as illustrated clearly in the figure, the first and second moving contacts 20 and 20*a* are made in a single body, partly contained inside a moving part 30.

The kinematic tripping device used in the second embodiment includes a first and a second member 45 and 46 mutually coupled by means of a first hinge 47. The first member 45 is also coupled to said moving contact 20 by means of a second hinge 48, while the second member is associated with said moving part by means of a third hinge 49. Basically, the kinematic tripping device is achieved in this solution using two members coupled by means of a kinematic pair that can itself act as the operative member of the kinematic system, as we can clearly see from FIG. 5. The rotation of the first moving contact 20 displaces the first hinge 47, which intercepts the trip shaft 40, or preferably a shaped tooth 6*b* projecting therefrom. As an alternative to the solution illustrated in FIG. 5, the two members 45 and 46 of the kinematic system can be mutually hinged at one of their intermediate points: this advantageously enables one free end of one of the two members to be used to move the trip shaft, for instance.

The two kinematic tripping systems illustrated above in the two possible embodiments of the invention are perfectly equivalent and interchangeable, and can also be replaced by other, functionally equivalent kinematic systems suitable for actuating the trip shaft by means of a kinematic action that starts with the clcctrodynamic separating movement of at least one of the moving contacts of the circuit breaker.

The above-illustrated kinematic tripping devices can be realized equally well in fixed or adjustable versions to allow for different tripping thresholds. For instance, in the kinematic system illustrated in FIGS. 1 to 4, the adjustment could be made by changing the length of the sliding rod 11 by means of micrometric screws 11*c* mounted, for example, in line with the first operative extremity 11*a*. Alternatively, the adjustment can be made by making the position of the protrusion 41 on the trip shaft 40 adjustable. In the solution illustrated in FIG. 5, said adjustment could be achieved, for instance, by means of a pantograph connection between the first and second members 45 and 46.

The technical solutions adopted fully achieve the previously specified aim and objects. That is to say, the automatic circuit breaker 1 conceived in this way allows for an ample range of possible settings. The use of a kinematic tripping device driven by the displacement of one of the moving contacts of the circuit breaker ensures an extremely timely response and a consequently high tripping precision. The kinematic tripping device according to the invention is also extremely reliable, straightforward and composed of a limited number of pieces, making it easy to assemble and demanding only ordinary maintenance.

The automatic circuit breaker according to the invention may undergo numerous changes and may have numerous variants, all covered by the inventive concept. Moreover, all the parts may be replaced by other technically equivalent components.

In practical terms, the materials and dimensions can be varied according to need and the state of the art.

The invention claimed is:

1. An automatic single-or multi-pole circuit breaker for use in low-voltage applications comprising:

at least a first fixed contact suitable for coupling/uncoupling with a first moving contact;

an operating mechanism operatively connected to said moving contact, said circuit breaker comprising a kinematic tripping device operatively connected to said moving contact and comprising an operative member suitable for activating said operating mechanism, said kinematic tripping device being driven by a first separating movement of said moving contact away from said fixed contact and activating said operating mechanism, which consequently acts on said moving contact, determining a second rapid separating movement of said moving contact away from said fixed contact, wherein said automatic circuit breaker comprises a moving part, which contains at least a part of said moving contact and a trip shaft, the movement of which activates said operating mechanism, said trip shaft being driven directly by means of the movement of said operative member of said kinematic tripping device, wherein said operative member consists of a sliding rod, which has a first operative extremity for moving said trip shaft and a second operative extremity, wherein said moving part includes a first seat for slidingly containing said sliding rod, wherein said moving contact includes a second seat, in which the second operative extremity of said sliding rod is slidingly inserted.

2. The automatic circuit breaker as in claim 1, further comprising a contact spring contained inside said moving part, said contact spring being fastened at one end to said moving part and at the other end to said first moving contact.

3. The automatic circuit breaker as in claim 1, wherein said sliding rod being of fixed or adjustable length.

4. The automatic circuit breaker as in claim 3, wherein said sliding rod is adjustable by means of a micrometric screw associated with said operative extremity.

5. The automatic circuit breaker as in claim 4, wherein said trip shaft includes a shaped protrusion suitable for engaging with said first operative extremity of said sliding rod.

6. The automatic circuit breaker as in claim 1, wherein said kinematic tripping device includes a first and a second member mutually coupled by means of a first hinge, said first member being associated with said moving part by means of a second hinge, and said second member being coupled to said moving part by means of a third hinge, said trip shaft being activated directly by means of said first and/or said second member of said kinematic tripping device and/or by means of said first hinge.

7. The automatic circuit breaker as in claim 6, wherein said trip shaft includes a shaped tooth suitable for engaging with said first and/or said second member.

8. The automatic circuit breaker as in claim 7, further comprising a second fixed contact suitable for coupling/uncoupling with a second moving contact at a second coupling surface, said second moving contact being made in a single body with said first moving contact.

9. The automatic circuit breaker as in claim 8, wherein said operating mechanism includes:

a first rotating body hinged to rigid supporting sides and operatively connected to said trip shaft;

a first connecting rod hinged to said first rotating body;

a second connecting rod hinged to said moving part and hinged also to said first connecting rod by means of a kinematic knee;

an operating spring operatively connected to said kinematic knee and suitable to be preloaded by means of an operating lever, said trip shaft enabling the movement of said first rotating body and the consequent release of the energy stored by said operating spring.

10. The automatic circuit breaker as in claim 9, wherein said operating mechanism includes a trigger situated between said trip shaft and said first rotating body, said trigger releasing said rotating body as a result of the displacement of said trip shaft by said kinematic tripping device.

11. The automatic circuit breaker as in claim 1, wherein said operative member consists of a rigid or elastic extension of said first moving contact.

* * * * *